United States Patent [19]

Davis et al.

[11] 4,126,131

[45] Nov. 21, 1978

[54] FACEMASK AND GOGGLE COMBINATION FOR EXCLUDING SMOKE OR NOXIOUS GASES FROM THE GOGGLES

[75] Inventors: Donald G. Davis, Azusa; John Wippler, Downey, both of Calif.; David L. Heitman, Midwest City, Okla.

[73] Assignee: Sierra Engineering Co., Sierra Madre, Calif.

[21] Appl. No.: 779,138

[22] Filed: Mar. 18, 1977

[51] Int. Cl.[2] ..... A62B 7/00

[52] U.S. Cl. ..... 128/142.4; 128/146.3; 2/436

[58] Field of Search ..... 128/140 R, 141 R, 142 R, 128/142.2, 142.3, 142.4, 145 A, 146 R, 146.3, 146.4, 146.7, 147, 139; 2/436

[56] References Cited

U.S. PATENT DOCUMENTS 3,971,368 7/1976 Forbes et al. ..... 128/142 R

*Primary Examiner*—Henry J. Recla

*Attorney, Agent, or Firm*—Donald D. Mon

[57] ABSTRACT

A face mask for supplying oxygen to personnel such as flight crews during times when there is inadequate air available, has fitted to it a device containing a passageway leading from the interior to the exterior of the mask, and a manually operable, slidable valve stem adapted in a first position to block the exit through the passageway of gas within the mask, and in a second position to open the passageway to permit the flow of gas from the interior to the exterior of the mask. The exit opening from the passageway is located at the upper nose area where it will be encompassed within the cavity of a goggle fitted over the vicinity of the eyes of the user. By manually moving the valve stem to the position where the passageway is open, oxygen from within the face mask is forced into the goggle cavity to flush out from the goggle cavity any smoke or noxious gas which may be present within it.

16 Claims, 6 Drawing Figures

16b
16c
16e
26e
15a
13
6
42
43
23
16d
26c
23b
42
23a
27
15d
23c
26c
26b
6
26a
26
26d
34
29
24
30
15b
5
5
16a
46
15
32
31
33
16f
15c
16
35
36
39
38
35a
40
37
41
25
25a
15

30
16a
15b
46
24
29

16b
16c
18
16d
48

4
23c
15b
26c 49
49
35a
45
45
25
4
16b
47
21
16a
22
15

FACEMASK AND GOGGLE COMBINATION FOR EXCLUDING SMOKE OR NOXIOUS GASES FROM THE GOGGLES

This invention relates to control of smoke or noxious gas which may be present in a goggle being used in conjunction with a face mask of a type which supplies breathable gas, ordinarily oxygen, to a user.

It is well known that face masks into which breathable gas, ordinarily oxygen, is supplied, are commonly provided for persons who are subjected to unusual environmental conditions. An important use for such breathing masks is in aircraft wherein the atmosphere may become deficient in oxygen, or may contain noxious gases such as smoke in emergency situations. Where there is an oxygen deficiency for any reason, the personnel subjected to this situation will don a breathing mask which fits over the nose and mouth of the user providing a cavity between the inner wall of the mask and the face of the user. An adequate supply of oxygen can be sent into this cavity. It is usually desired that there be no significant loss or diversion of the available oxygen supply, in order that the oxygen thus made available to the user of the mask shall last as long as possible.

It is also common for personnel who may be subjected to such emergency situations, to use a goggle for protection of the eyes from visual impairment from noxious gases or smoke in the ambient atmosphere. It is a common experience, however, for such smoke or noxious gas to become trapped within the goggle before the goggle can be properly applied to exclude it. Under such circumstances, the user can remain subjected to visual impairment even after the goggle is applied.

Means have heretofore been proposed for flushing such smoke or noxious gas from the goggle. Such an arrangement is shown in U.S. Pat. No. 3,971,368, issued July 27, 1976, which discloses a face mask for furnishing oxygen to the nose and mouth, and a goggle over the eyes. The face mask is provided with an exit opening, normally closed by a valve, at the position of the face mask which becomes covered by the goggle. The act of setting the goggle over the eyes automatically opens the valve so that oxygen from the cavity within the face mask flows into the goggle under enough pressure to flush the smoke or noxious gases out of the goggle at the region around its border.

The arrangement of said U.S. Pat. No. 3,971,368 has the disadvantage that the oxygen must flow into and out of the goggle during the entire time that the goggle is attached to the face. This results in an undesirably rapid loss of the oxygen supply and correspondingly reduces the time which the user may spend under such adverse ambient conditions.

An object of the present invention is to provide means capable of incurring no loss of the oxygen or breathable air supply after an initial flushing of noxious gas or smoke from the goggle.

The invention is carried out by provision of a manually operable valve means at a passageway means leading from within the cavity of the face mask to the exterior of the mask at a position which will be within a goggle cavity when the goggle is worn. By reason of this valve arrangement, no breathable gas or oxygen exits from the face mask until the valve is manually opened. In practice, the user will not ordinarily open the valve to permit oxygen to exit from the face mask until after the goggle is properly set in place. Then if smoke or other noxious gas be trapped within the goggle, the valve can be manually opened for only a brief time which need be only long enough to flush the smoke or noxious gas from the goggle cavity, after which the valve can be manually closed again during all the time that the goggle is worn.

A preferred feature resides in the provision of a valve stem which can be manually moved to a first position where it blocks the passageway to prevent the exiting of gas from the face mask, and also to a second position where it is clear of the passageway thus permitting the exiting of gas through the passageway.

Another feature resides in structural means attaching the passageway means and valve to the mask, preferably at the region of the nose.

The foregoing and other features of the invention will be better understood from the following detailed description and the accompanying drawings of which:

Figures 1, 6:
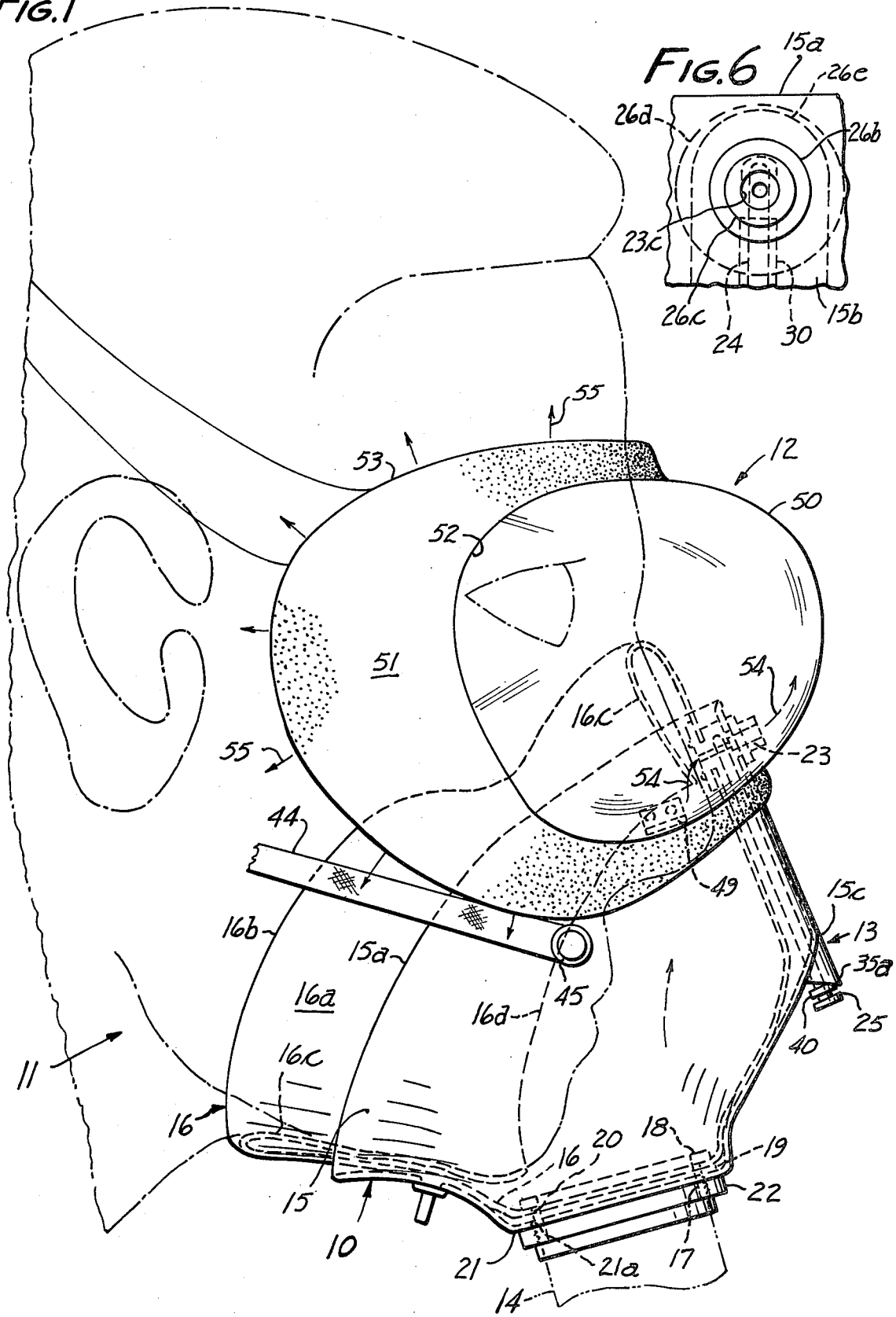
FIG. 1 is a view from the side with a partial top view. showing a breathing mask and a goggle on the face of a user in operative relation to each other and to the user and embodying a passageway for gas flow between the mask and the goggle, and showing a valve inlet to the goggle and manually operable valve control, according to this invention.
FIG. 6 shows a detail looking from line 6—6 of FIG. 4.

Referring to FIG. 1 there is shown a breathing mask 10 covering the nose and mouth area of the face 11 of a user, and a goggle 12 covering the area of the eyes of the user. There is also provided a device 13 mounted to the nose area of the mask, the upper portion being within the goggle and containing a passageway 23 leading from within the mask and into the goggle. The lower portion extends downwardly below the goggle along the front of the mask and contains a valve stem 24 (seen in FIGS. 4, 5 and 6) for control of gas flow through passageway 23, and a control knob 25 for manual control of the valve stem. The breathing mask is provided with the usual delivery conduit 14 for delivery of breathable gas, ordinarily oxygen, into the interior of the mask.

The breathing or oxygen mask 10 is of a generally conventional form, comprising a hard shell 15 made of a rigid material such as a rigid plastic and shaped to be positioned in front of the mouth and nose area of the user and to be brought beneath the chin. The hard shell has within it a liner 16 of a flexible material such as a sheet of rubber-like plastic. This liner has a portion **16*a* which extends beyond the hard shell periphery 15*a*, and at the liner periphery 16*b* it is folded forwardly to provide a re-entrant fold 16*c* which extends to a periphery 16*d* and lies snugly against the face and nose and underside of the chin of the user. The liner 16 is fixed to the hard shell 15 by means of a flanged nipple 17 whose flange 18 bears against the inside surface of liner 16 at the region of an opening 20 through liner 16. It is also preferably attached to the hard shell at one or more other places by suitable means (not shown). The hard shell has a flat annular region 21 through which there is an opening 21***a* which registers with the opening 20 through liner 16 so that the nipple extends downward through these openings of members 15 and 16 and through a washer 19 between the hard shell and the liner, to be engaged by a nut 22 at the outer surface of hard shell 15. The tube 14 for supplying the oxygen or breathing gas is fixed within the nut.

According to common practice, the mask is held in its operative position at the user's face by bayonet members 44 (one of which is partically shown in FIG. 1) attached to a bushing 45 fixed to the hard shell and extending rearwardly along opposite sides of the head to customary head gear which secures to the head.

When the mask is thus fitted in its operative position at the face of the user, the liner fold 16*c* fits snugly to the face and nose, leaving no space between the liner fold and any part of the face or nose through which gas may pass. In this position, the hard shell and liner of the mask are spaced sufficiently forward of the mouth and nose area to provide a cavity between the inner wall of the mask liner and this area of the face, for containing breathable gas.

Figure 4:
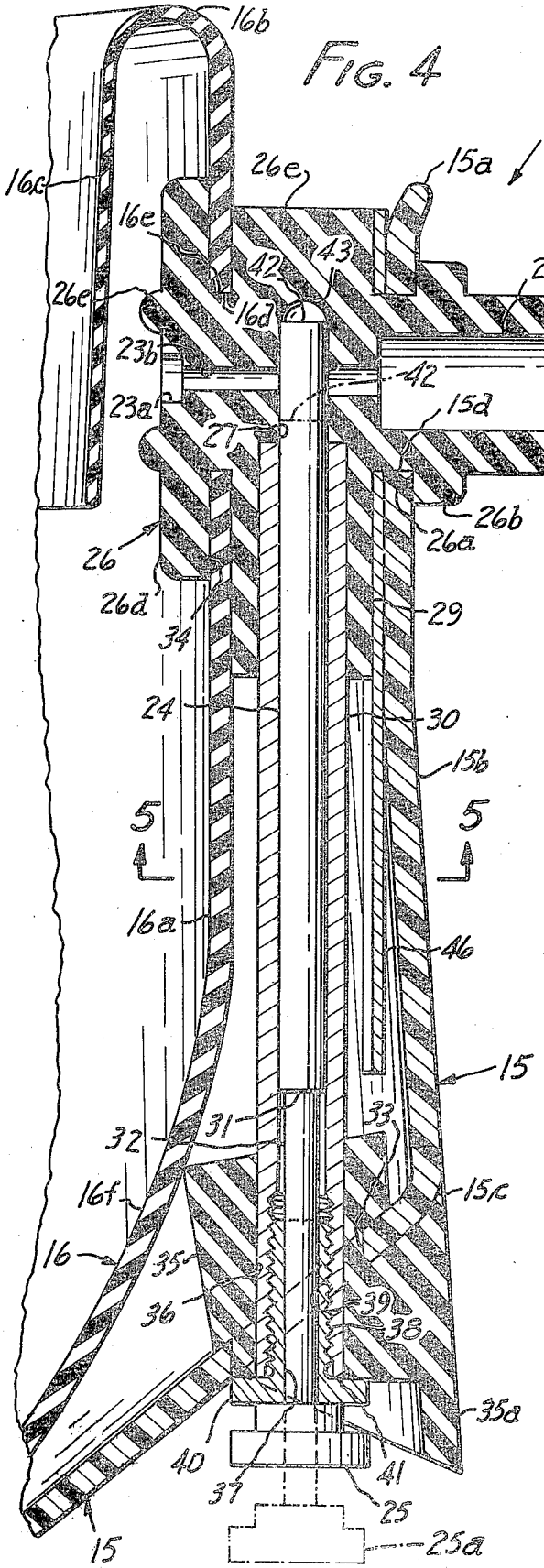
FIG. 4 is an enlarged cross-section view taken at line 4—4 of FIG. 2, showing details of the gas passageway, the valve and the valve control at the nose area of the mask.

The device 13 containing the exit passageway 23 from the mask cavity and the valve stem 24 and valve control 25, comprises a grommet 26, best seen in FIG. 4. The passageway 23 extends from one end to the other of the grommet, along its axis. At the end within the mask the passageway has a substantial cross-section area at 23*a* which meets a section 23*b* of significantly lesser crossection area followed by a section 23*c*, at the exit end where the passageway has its greatest cross-section area at 23*c*. A bore 27 extends from the lower side of the grommet on an axis perpendicular to the axis of passageway 23 and intersects the passageway, for the purpose of receiving the upper end of the cylindrical valve stem 24. The grommet is provided with a hollow cylindrical depending member 29 of larger internal diameter than the diameter of the bore 27 and coaxial with the bore. The upper end of a rigid tubular member 30 is fitted within cylindrical portion 29 and fixed thereto in a suitable manner, as by adhesive. The internal diameter of tubular member 30 is the same as the diameter of bore 27. The valve stem 24 is of the same diameter as the internal diameter of the bore and of the tube 30, making a sliding fit therein. This uniform outer diameter of the stem continues downward to a position 31 where it narrows to a smaller diameter 32 which extends to a position below the lower end of the hollow tube 30. The knob 25 is fixed to this lower end of stem portion 32. A hollow bushing 37 provided with exterior threads 38 is threaded into threads 39 within the lower end of tube 30 until a flange 40 of the bushing meets the lower end 41 of the tube.

The valve stem 24 is slidable axially within the tubular member 30 which may be done manually by grasping the knob 25, and in doing this the lower valve stem section 32 slides through bushing 37. There is a close enough fit between the stem section 32 and the inner wall of the bushing 37 to create sufficient friction therebetween so that the stem will remain in whatever position it is left after a manually operated movement. In FIG. 4 the valve stem is shown in its uppermost position where the upper end 42 of the valve stem engages the upper rounded end of bore 43, so that this upper end blocks the passageway 23 at section 23*b*. The lowermost position is that where the lower end 31 of the valve stem abuts the upper end of bushing 37. This lowermost position is shown in phantom by the position 25*a* of knob 25, and the lower position of the valve stem top, so that its upper end no longer blocks the passageway 23.

Figure 2:
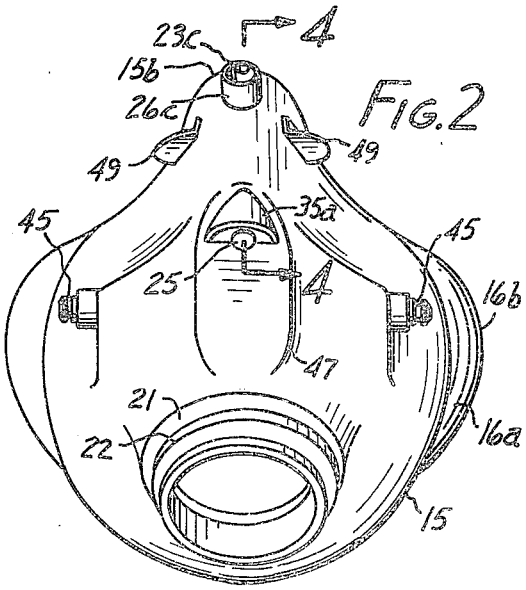
FIG. 2 is a view of the mask looking upward from its front.

The device 13 is held to the mask by provision of an opening 33 through the hard shell 15, through which the tube 30 of device 13 is inserted. At a position slightly inside the opening 33 the liner 16 separates from the hard shell and extends upwardly at 16*a* along the inside of tubular member 30 to the liner periphery 16*b*. At the region of the grommet 26 the portion 16*a* of the liner is placed between the portion 29 and the inside flange portion 34 of the grommet. To provide for passage of the grommet through the liner, the liner is provided with an opening 16*d* so that the material of the liner around this opening can be fitted within a circular slot 16*e* formed in the grommet. Below its region 16*a* the liner increases its separation from the tubular member 30, and it accomodates a rubber-like plug 35, which may be of a suitable plastic, inserted through the opening 33 of the hard shell. The plug has an opening 36 permitting passage of tubular member 30 through it. The plug will be put into its position before the threading of bushing 37 into tube 30. Thus when the bushing is fully threaded into the tubular member 30, its flange 40 comes into contact with the bottom of the plug as well as the lower end of the tubular member. At the lower outside portion of the plug there is formed a depending lip 35a which is approximately semi-circular, as seen in FIGS. 2 and 4. This tends to protect the parts 25 and 40 from inadvertent knocks.

Just outside opening 33, the hard shell 15 is carried upward adjacent the tubular member 30 at region 15*b*. Beginning at a lowermost position 15c this portion 15*b* is formed into the shape of a U, as seen in FIGS. 2 and 5.

Figure 5:
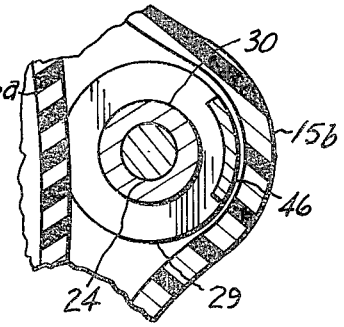
FIG. 5 is a cross-section view showing a detail taken at line 5—5 of FIG. 4.
Figure 3:
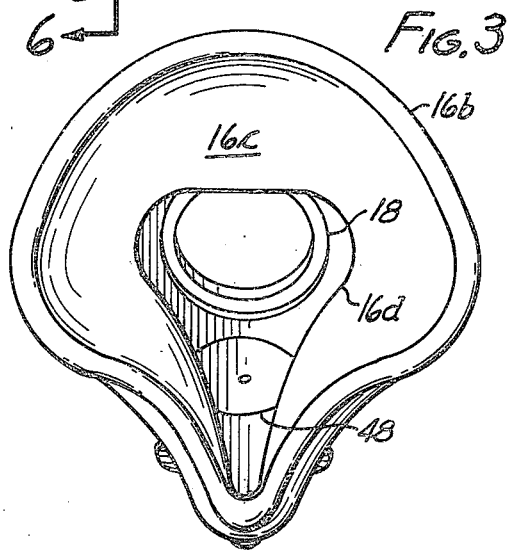
FIG. 3 is a view looking into the mask from its rear.

Within the U there is a strip 46, preferable of rigid metal and arcuate in cross-section as seen in FIG. 5. This strip 46 is fitted between the forward part of the cylindrical depending member 29 of grommet 26 and the inner wall of U-shaped portion 15b of the hard shell as best seen in FIGS. 4 and 5. The hard shell portion 15*b* is provided with an opening 15*d* and the material of the hard shell around this opening is fitted within an annular notch 26*a* located somewhat beneath the rounded top portion 26*e* of the grommet, formed between a flange 26*b* of the grommet and the depending cylindrical portion 29. The grommet which is preferably of a compliant rubber-like material, has a tubular portion 26*c* extending forwardly beyond the flange 26*b*. Preferably the oval area 47 of the hard shell which encompasses the plug 35 and the region immediately below it is made flat and rigid by means of a rigid disc 48 fastened to the inner surface of the hard shell with the liner 16 therebetween within this area 47. It is seen that by this construction the tubular member 30 containing the valve stem 24 is firmly held at its upper end by the grommet secured to the hard shell, and at its lower end by the plug 35 which is also securely held to the hard shell. The inner circular surface 26*d* of the grommet is preferably provided with a number of inwardly protruding bumps 26*e* for the purpose of preventing the opening of the passageway portion 23*a* from being closely covered by the fold 16*c* of the liner. Such close and complete coverage of the passageway by the liner, if it should occur, would prevent passage of gas through the passageway even when the valve stem is moved to its open position.

Preferably a pair of angle members 49 are fixed to the hard shell near its upper forward portion at opposite sides of the grommet for the purpose of aiding in the positioning of a goggle as will be explained hereinafter.

The goggle 12 comprises the usual transparent member 50 which in this instance has a bulbous shape providing a cavity between its inner wall and the portion of the face in the vicinity of the eyes which it covers. The transparent element 50 is provided with a bordering element 51 sealed to element 50 all around its peripheral region 52. The material of the border element 51 is of a soft compliant texture such as flexible rubber or plastic sheet and is shaped around its outer periphery 53 to lie snugly against the face of the wearer at the regions where it can come into contact with the face and also to lie snugly over the upper portion of the mask hardshell 15. According to common practice the goggle is held in its position for good visibility by the wearer as shown in FIG. 1 by means of a strap arrangement (not shown) attached to the goggle and passed around the back of the head. In this position the upper end of the valve device 13 containing the grommet tube **26*c* and the passageway section 23*c* is included within the cavity of the goggle so that any passage of gas from the mask through passageway 23** exits into the goggle cavity.

In using this equipment, when there occurs a need for breathable gas such as oxygen, the mask will be attached to the face to supply the needed gas, and while doing this the knob 25 for manually adjusting the valve stem will generally be pushed to its first or uppermost position to prevent loss of the breathable gas through the passage 23. If and when there is experienced smoke or other noxious gas which could interfere with vision, the goggle will then be applied in the position shown in FIG. 1 and the knob 25 will then be pulled down to its second position **25*a* to open the passageway 23. This will cause some of the breathable gas which has entered the mask cavity to flow outward through passageway 23, as indicated by arrows 54, into the goggle cavity. Since the breathable gas entering through supply conduit 14 is under a somewhat greater pressure than the pressure of the ambient atmosphere within the aircraft cabin or other enclosure in which the user may be, this breathable gas within the goggle cavity will seep out of the goggle cavity around the periphery 53 of the border material 51, as indicated by arrows 55. Since the resilient border material 51 lies substantially flat against the face and mask at the periphery 53, the pressure within the goggle is sufficient to lift the border material enough to permit this seepage. But this gas pressure does not lift the mask liner 16 away from the face because of the presence of its fold 16*c*. The effect of the pressure is to hold the fold 16*c*** against the face. Hence there is no significant seepage of gas between the face and the liner.

When this flow of breathable gas represented by arrows 54 and 55 has flushed the smoke or noxious gas from within the goggle cavity, the wearer may then close the passageway 23 by pushing valve stem knob 25 to its uppermost position. This will prevent further loss of the breathable gas from the mask and thereby conserve the breathable gas or oxygen supply.

This invention is not to be limited by the embodiments shown in the drawings and described in the description, which are given by way of example and not of limitation, but only in accordance with the scope of the appended claims.

We claim:

1. In equipment for aiding breathing and vision, of the type comprising:

goggle means having a transparent element covering the eyes of a user and defining a goggle cavity;

face mask means adapted to fit the face area around a user's nose and mouth to provide a mask cavity between the mask means and the face area and to be used simultaneously with said goggle means covering the eyes of the user;

means for injecting breathable gas into said mask cavity;

an exit passageway from said mask cavity to the exterior of the mask means and extending within said goggle cavity between said transparent element of said goggle means and the eyes of the user; and and means at said passageway, capable of permitting or preventing egress of gas from said mask cavity;

the improvement wherein:

said means at said passageway is a slidable valve means having a longitudinal axis, which can be slid longitudinally into and out of the passageway; and said improvement comprises:

means for sliding said valve means to a first position at which said passageway is blocked, thereby preventing egress of gas from the mask cavity, and to a second position at which said passageway is unblocked, thereby permitting egress of gas from the mask cavity; and manually operable means attached to said valve means for sliding the valve means, located outside of the mask cavity at a position where it is always outside the goggle cavity so that it can be manually operated at all times including times when the goggle means is fitted to the face in its said normal position;

whereby when the goggle means is placed over the user's face in a manner positioning the goggle cavity at the vicinity of the eyes the breathable gas flows through the passageway from the mask cavity into the goggle cavity to flush the goggle cavity when said manually operable means slides said valve means to its first position, but is blocked from flowing out of the mask cavity when said valve means is slid to its second position.

2. The improvement according to claim 1 in which the means for sliding said valve means comprises a longitudinally slidable valve stem.

3. The improvement according to claim 2 in which the slidable valve means comprises an end portion of the valve stem, said end portion intersecting the passageway in said first position and being clear of the passageway in the second position.

4. The improvement according to claim 3 including a grommet extending from said mask cavity to the exterior of the mask means to a position within the goggle cavity when the goggle means is fitted to the face of the user in its said normal position, said grommet containing a bore, said passageway extending through said grommet and intersecting said bore, said end portion of the stem entering into said bore in said first position and being out of said bore in the second position.

5. The improvement according to claim 4 in which the grommet contains a tube portion which protrudes forwardly from the mask, and said passageway exits through said tube portion.

6. The improvement according to claim 5 wherein said goggle means is fitted over the area of the face including the eyes over the upper portion of the mask means and including said exit passageway and having a border of a material which lies against the face and against the upper portion of the mask means said border material having a flexibility which permits seepage of gas from the goggle cavity around the periphery of the border material when the valve means is in its first position while breathable gas is injected into said mask cavity.

7. The improvement according to claim 4 including a tubular member leading from said grommet to the exterior of the face mask means, through which the valve stem slides.

8. The improvement according to claim 7 in which the tubular member is encompassed by the outer wall of the mask means.

9. The improvement according to claim 8 wherein said goggle means is fitted over the area of the face including the eyes and having a border of a material which lies against the face and against the upper portion of the mask means said border material having a flexibility which permits seepage of gas from the goggle cavity around the periphery of the border material when the valve means is in its first position while breathable gas is injected into said mask cavity.

10. The improvement according to claim 7 wherein said goggle means is fitted over the area of the face including the eyes over the upper portion of the mask means and including said exit passageway and having a border of a material which lies against the face and against the upper portion of the mask means said border material having a flexibility which permits seepage of gas from the goggle cavity around the periphery of the border material when the valve means is in its first position while breathable gas is injected into said mask cavity.

11. The improvement according to claim 4 wherein said goggle means is fitted over the area of the face including the eyes over the upper portion of the mask means and including said exit passageway and having a border of a material which lies against the face and against the upper portion of the mask means said border material having a flexibility which permits seepage of gas from the goggle cavity around the periphery of the border material when the valve means is in its first position while breathable gas is injected into said mask cavity.

12. The improvement according to claim 3 in which the manually operable means comprises a knob fixed to the end portion of said valve stem opposite said slidable valve means.

13. The improvement according to claim 12 wherein said goggle means is fitted over the area of the face including the eyes over the upper portion of the mask means and including said exit passageway and having a border of a material which lies against the face against the upper portion of the mask means said border material having a flexibility which permits seepage of gas from the goggle cavity around the periphery of the border material when the valve means is in its first position while breathable gas is injected into said mask cavity.

14. The improvement according to claim 3 wherein said goggle means is fitted over the area of the face including the eyes over the upper portion of the mask means including said exit passageway and having a border of a material which lies against the face and against the upper portion of the mask means said border material having a flexibility which permits seepage of gas from the goggle cavity around the periphery of the border material when the valve means is in its first position while breathable gas is injected into said mask cavity.

15. The improvement according to claim 2 wherein said goggle means is fitted over the area of the face including the eyes over the upper portion of the mask means and including said exit passageway and having a border of a material which lies against the face and against the upper portion of the mask means, said border material having a flexibility which permits seepage of gas from the goggle cavity around the periphery of the border material when the valve means is in its first position while breathable gas is injected into said mask cavity.

16. The improvement according to claim 1 wherein said goggle means is fitted over the area of the face including the eyes over the upper portion of the mask means and including said exit passageway and having a border of a material which lies against the face and against the upper portion of the mask means said border material having a flexibility which permits seepage of gas from the goggle cavity around the periphery of the border material when the valve means is in its first position while breathable gas is injected into said mask cavity.

* * * * *